US006871357B2

(12) United States Patent
Herman et al.

(10) Patent No.: US 6,871,357 B2
(45) Date of Patent: Mar. 29, 2005

(54) FLOTATION SWIM GARMENT FOR CHILDREN

(76) Inventors: Talia Herman, Box 2501, Waco, TX (US) 76702; Linda Karafortias, 10745 SW. Wedgewood St., Portland, OR (US) 97225

( * ) Notice: Subject to any disclaimer, the term of this patent is extended or adjusted under 35 U.S.C. 154(b) by 0 days.

(21) Appl. No.: 10/445,702

(22) Filed: May 23, 2003

(65) Prior Publication Data

US 2004/0231025 A1 Nov. 25, 2004

(51) Int. Cl.[7] ..... A41D 7/00
(52) U.S. Cl. ..... 2/67; 441/114
(58) Field of Search ..... 2/69, 80, 67, 75, 2/102, 108; 434/254; 441/106, 114, 115, 117, 108, 88, 120

(56) References Cited

U.S. PATENT DOCUMENTS

| | | | | | |
|---|---|---|---|---|---|
| 286,660 | A | * | 10/1883 | Weil | 2/67 |
| 1,562,720 | A | * | 11/1925 | Pettee et al. | 441/102 |
| 1,730,812 | A | * | 10/1929 | Ford | 441/102 |
| 1,742,368 | A | * | 1/1930 | Nunez | 441/102 |
| 1,800,960 | A | * | 4/1931 | Savard | 441/102 |
| 1,803,898 | A | * | 5/1931 | Diamond | 441/102 |
| 1,985,568 | A | * | 12/1934 | Hall | 441/102 |
| 2,197,228 | A | * | 4/1940 | Then | 441/102 |
| 2,197,324 | A | * | 4/1940 | Sommers et al. | 441/102 |
| 2,329,093 | A | * | 9/1943 | Sommers et al. | 441/102 |
| 3,094,722 | A | * | 6/1963 | Lerner | 441/102 |
| 3,134,994 | A | * | 6/1964 | Christofferson | 441/102 |
| 3,141,180 | A | * | 7/1964 | Pursley et al. | 441/102 |
| 3,144,668 | A | * | 8/1964 | Palesotti | 441/102 |
| 3,204,264 | A | * | 9/1965 | Mitsuo et al. | 441/102 |
| 4,052,762 | A | * | 10/1977 | Zawislak | 441/102 |
| 4,276,670 | A | | 7/1981 | Marchello et al. | |
| 4,291,427 | A | | 9/1981 | Rhea | |
| 4,519,783 | A | | 5/1985 | Burke, Jr. | |
| 4,619,622 | A | * | 10/1986 | McDonald et al. | 441/111 |
| 5,013,271 | A | * | 5/1991 | Bartlett | 441/65 |
| 5,030,153 | A | | 7/1991 | Bailey | |
| 5,184,968 | A | * | 2/1993 | Michalochick et al. | 441/116 |
| 5,413,485 | A | | 5/1995 | Adee | |
| 5,452,477 | A | * | 9/1995 | Mann | 2/67 |
| 5,459,874 | A | * | 10/1995 | Meredith | 2/67 |
| 5,502,842 | A | * | 4/1996 | Wagner | 2/67 |
| 5,588,892 | A | * | 12/1996 | McMahon | 441/116 |
| 5,775,967 | A | | 7/1998 | Lacoursiere et al. | |
| 5,778,451 | A | * | 7/1998 | Rhea | 2/67 |
| D424,153 | S | * | 5/2000 | Shaffer | D21/804 |
| 6,112,327 | A | * | 9/2000 | Shaffer | 2/67 |
| 6,260,199 | B1 | * | 7/2001 | Grunstein et al. | 2/69 |
| 6,676,467 | B1 | * | 1/2004 | Filsouf | 441/90 |

* cited by examiner

*Primary Examiner*—John J. Calvert
*Assistant Examiner*—Alissa L. Hoey
(74) *Attorney, Agent, or Firm*—David G. Henry

(57) ABSTRACT

A child's flotation swim garment which includes integral flotation panels. The panels include elongate indentations for facilitating movement and comfort for wearers, and overlying garment fabric is made to conform to the indentations of the flotation panels and present an outwardly visible indication of the contours of the underlying flotation panels.

2 Claims, 2 Drawing Sheets

FLOTATION SWIM GARMENT FOR CHILDREN

BACKGROUND OF THE INVENTION

1. Field of the Invention

The present invention relates to water safety devices.

2. Background Information

Any loss of a child is tragic, but a loss through drowning is among the most so. Why? Because: (1) such a loss is almost always completely preventable (unlike most disease); and (2) the loss arises from something (unlike transportation, which is a modern necessity) which is usually, merely recreational. To a parent or loved one who has lost a child to drowning, these factors make the loss, however bad to begin with, all the more tortuous.

In 1998 (the last year for which the statistics have as yet been fully compiled), 4,406 people drowned, of which 1,003 were children younger than 15 years old. At present, this makes drowning the second leading cause of death among children in the United States, and in Arizona, Florida, and California, it is the number one cause of death for children under five.

Were one to assume that a swimming pool is a safe environment for a child (as opposed to open water at a beach, etc.) he or she would be mistaken. 350 children drown in swimming pools each year in the Untied States, and an additional 2400 more are nearly drowned according to government statistics; many of which result in totally disabling brain damage.

Adult supervision of children in and near water is quite correctly cited as the single most important safety practice for preventing drownings, but even that falls well short in adequately addressing the threat to our children. A U.S. Consumer Product Safety Commission study, conducted over a five year period, showed that, at the time of the incidents, most victims were, in fact, being supervised by one or both parents.

Clearly something more must be done to address the losses of children to drowning, in this and all countries.

Various safety devices are certainly well-known. Life jackets, "swim wings", flotation belts, and even garments with integral flotation units are known. However, either through non-use, incorrect use, or product design deficiencies, these products are self-evidently not solving the problem.

A child safety product is needed which: (1) is optimally effective when used; (2) is, because of design simplicity to the end-user, unlikely to be used incorrectly so as to compromise effectiveness; (3) is resilient and robust (e.g. will not become dysfunctional during normal use); (4) inherently conveys its safety potential to those who must be motivated to purchase the product, even though they are not the intended end-users; (5) is adequately non-intrusive during use to avoid resistance to use by children (is comfortable); and (6) is sufficiently aesthetically pleasing as to not put-off parents uring their purchasing decisions, or children during use (something which, while to many is, and should be a "non-issue", has been shown to be a contributing factor in purchasing and use of even safety-related products).

Presently available products fall short of one or a combination of these objectives. This is true, even of the product which is most closely related to that of the present invention—the child's swim wear product with integral flotation panels (see U.S. Pat. No. 6,260,199 issued to Grunstein).

The Grunstein garment is certainly a step in the right direction for child-protective swim wear in its inclusion of integral flotation panels. However, Grunstein fails to recognize that, under certain circumstances, the flotation panels may become dislodged from the garment, with tragic consequences. Furthermore, the Grunstein garment, with the specifically prescribed smooth outer surface in the areas of the flotation panels (see Column 4, lines 37, et seq), causes the garment to unattractively resemble an awkward marriage between a swimsuit and a old style life jacket. Not only is the seen as unattractive and, in some observers' words, "almost therapeutic", this feature de-emphasizes the most important feature of the product—its flotation features. Grunstein completely failed to recognize these deficiencies in his garment design—deficiencies which might, at first, seem trivial, but actually deter purchases of such life-saving products, according to information gathered by the present inventors.

At least one other deficiency of the Grunstein design is its lack of attention to the distribution of flotation from front to back of the garment. Particularly for a very young child, a garment which, while enabling a child to float, does nothing to urge the child to float on his or her back, is, at best, only a half-effective safety aid.

Clearly, something must be done to address child drownings, and getting life-saving products into the hands of parents, and having them placed in active use, can be a vital step in this direction.

SUMMARY OF THE INVENTION

In view of the foregoing, it is an object of the present invention to provide an improved flotation swim garment for children.

It is another object of the present invention to provide an improved flotation swim garment for children, the flotation features of which are less likely than those in presently available products, to be capable of separating from the garment during use.

It is another object of the present invention to provide an improved flotation swim garment for children, which, because of outer contours which reflect internal flotation panel features, reveals and emphasizes the intended function of the garment.

It is another object of the present invention to provide an improved flotation swim garment for children, which, because of outer contours which reflect internal flotation panel features, provides aesthetically pleasing features to promote purchase and use of the life saving product, to thereby reduce the likelihood of child drownings.

It is another object of the present invention to provide an improved flotation swim garment for children, which, in combination with the above features, incorporates integral flotations panels which are arranged to prompt face-up flotation by a child wearer.

In satisfaction of these and related objects, the present invention provides a child's flotation swim garment which includes integral flotation panels. The panels, somewhat like those taught in the Grunstein patent, include elongate indentations for facilitating movement and comfort for wearers. However, the overlying garment fabric in the present design is conformed to the indentations of the flotation panels to present an outward appearance which clearly indicates the underlying flotation panels. Because of the intentional visibility of the contours and shapes of the flotation panels, the indentations are arranged in, not only functional, but aesthetically pleasing arrays which will be clearly visible to any observers.

Both the visibility of the functional features of the present garment, taken with the aesthetic features, tend to promote customer (parent) acceptance of these products, and thereby indirectly increase safety for the intended end-users —our children.

Additionally, the cumulative volume of flotation material in the present garment is distributed such that more than 50% thereof is on the front side of the garment, thus promoting preferential flotation of a child on his or her back, rather than on their front.

DETAILED DESCRIPTION OF THE PREFERRED EMBODIMENT

Figure 1:
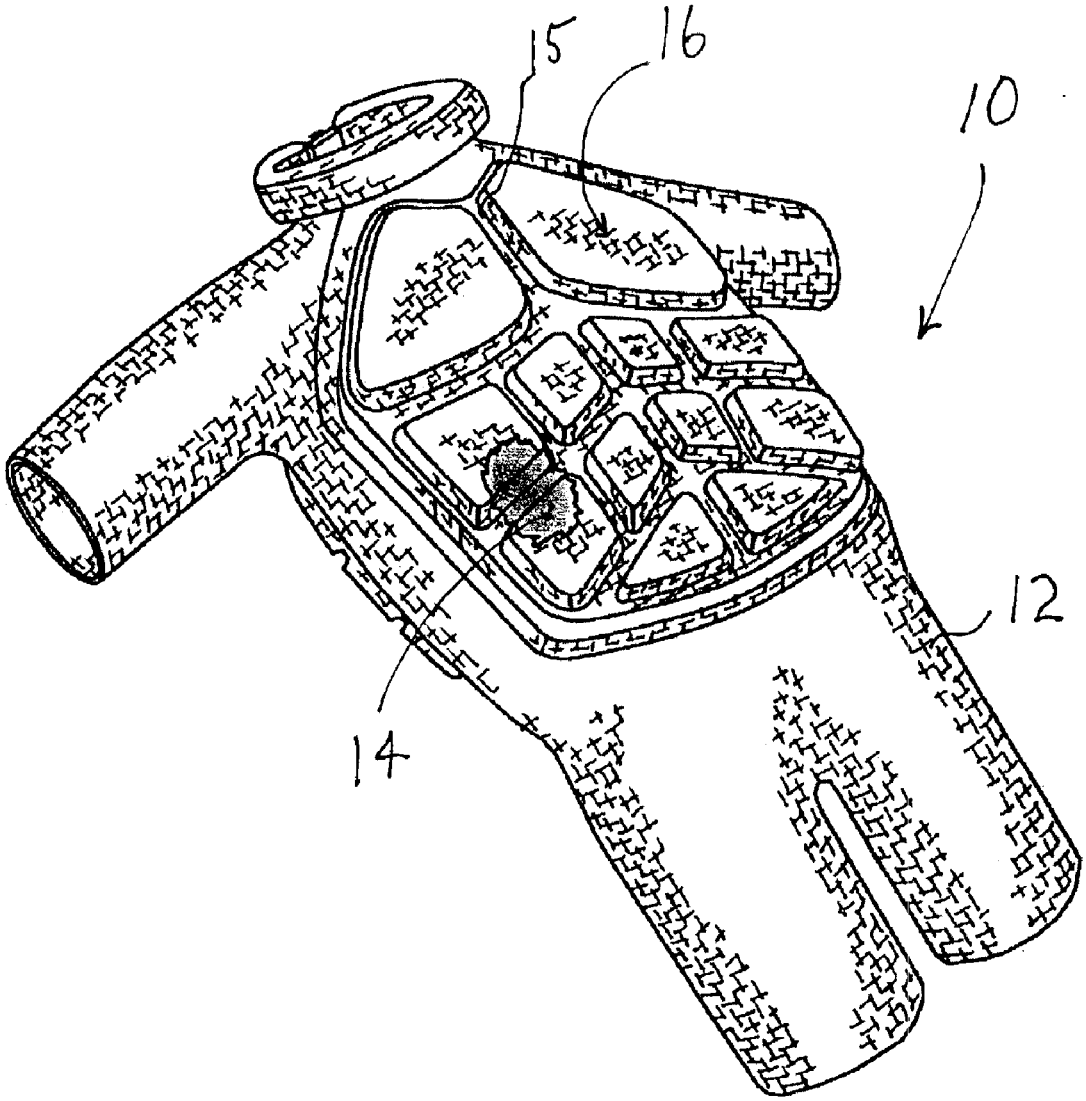
FIG. 1 is a perspective view of the preferred embodiment of the flotation garment 10 of the present invention, with a cut-away to reveal an integral flotation panel 14 which resides on the front side 16 of the garment 10.
Figure 2:
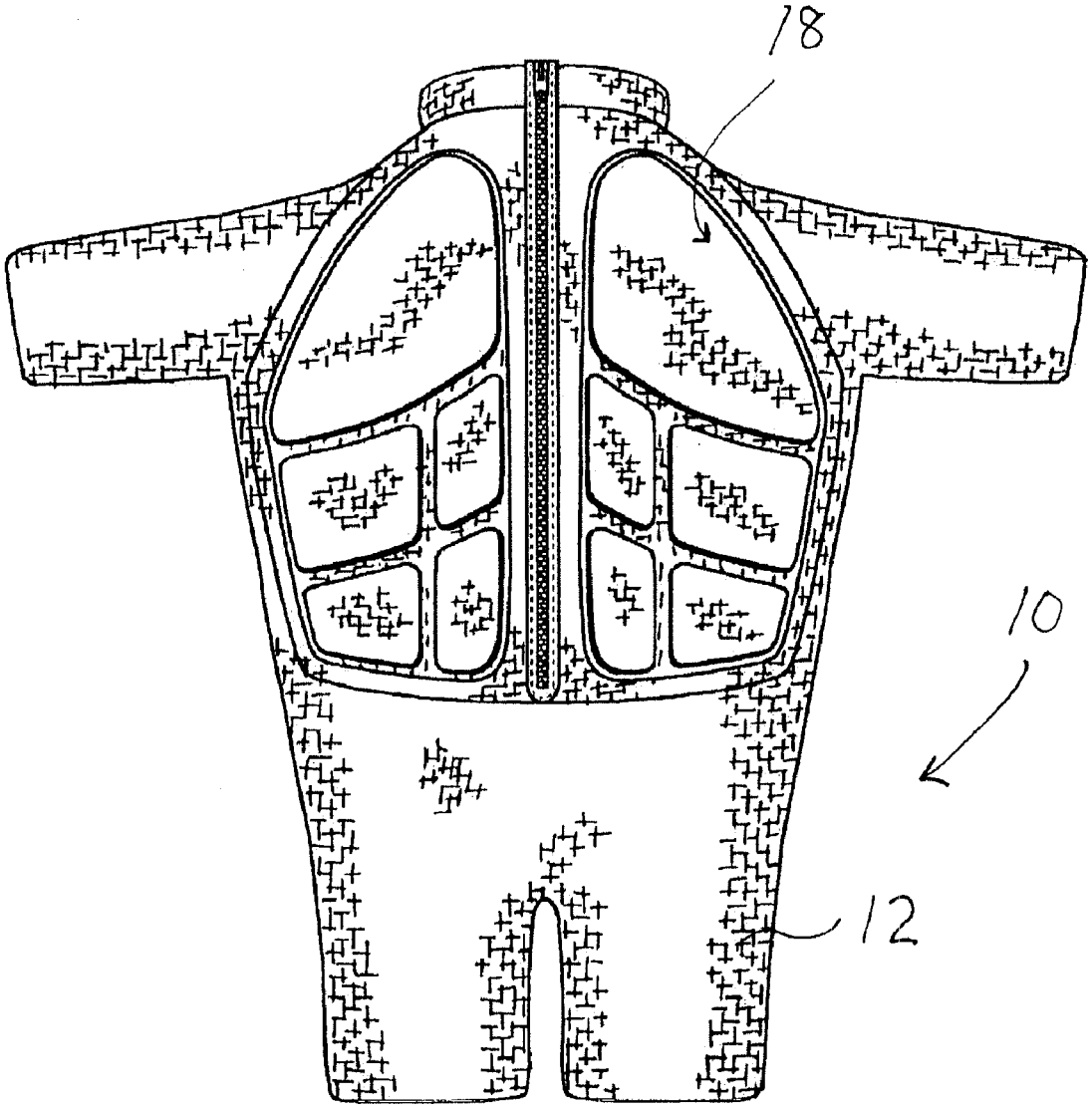
FIG. 2 is an elevational rear view 18 of the flotation garment 10 of the present invention.

Referring to FIG. 1, the improved flotation garment of the present invention is identified generally by the reference number 10. Garment 10 includes garment fabric 12 and a plurality of integral flotation panels 14, which are, in the preferred embodiment, sewn into interior "pockets" of garment 10.

Flotation panels 14 are contoured to exhibit patterns of elongate channels or indentations 15 which, in essence, serve as crease lines for accommodating movement of a wearer. By having elongate portions of the flotation panels which are, as compared to surrounding flotation material, thinner, and by having such portions positioned along areas along which the garment must bend to accommodate movement, wearing of the garment is, and is perceived to be, less constraining than a garment lacking this design feature.

Unlike the flotation garments of the prior art, however, the exteriorly visible portions of fabric 12 in garment 10 are, according to the present invention, mated closely with, and (using either thermal bonding, or a suitable waterproof adhesive) adhered to the underlying flotation panel contours. This is clearly visible in FIG. 1. This is a very important distinction from the prior art, which emphasizes the minimizing of the appearance of contoured flotation panels.

By securing fabric 12 to the underlying flotation panels 14, such that fabric 12 is adhered to, and closely "follows" the contours 15 of flotation panels 14, flotation panels will not likely ever separate from garment 10, even if fabric 12 is torn in the area in which flotation panels 14 are sewn. Conversely, the smooth fabric which overlies the flotation panels of the aforementioned Grunstein garment can, if the pocket in which the flotation panel is encased is breached (by tearing, or if a seam unravels), simply slip out of the pocket, especially if Grunstein's suggestion of removable or interchangeable panels is adopted. Such a catastrophic product failure would be very nearly impossible with the present design.

The robustness of the flotation panel and garment interface as just described certainly represents a direct safety improvement. However, as earlier referenced, certain indirect safety features are realized by the outwardly visible contouring of fabric 12, to reveal the corresponding contouring of flotation panels 14. Because the flotation features of garments 10 of the present invention are immediately recognizable by observing retail consumers, the invitation to obtain the safety product is strong. In fact, a recent market survey by the assignee of the present invention revealed that, by an approximately 6 to 1 margin, the present design was perceived as a more safety promoting design than a product according to the design depicted in Grunstein. This quite clearly can translate into higher sales, higher use, and correspondingly higher safety margins for consumers' children.

Also related to the outwardly visible contouring, but representing a completely separate issue is that of aesthetically attractive design. This same study revealed that consumers, by a large margin, simply preferred the appearance of garments of the present design. This too will promote sales, with the resulting, albeit indirect, safety dividend.

An additional feature of the present invention is the differential distribution of effective flotation as between the front side 16 and back side 18 of garment 10. Between approximately 60% and 70% of the effective flotation (and certainly not less than 50%) should be placed on the front side of garment 10 in an optimum embodiment of the present invention. This will prompt a child wearer to float, not on the face (which is little better than having no flotation device at all), but on the back, where the child can survive almost indefinitely.

The flotation material used, the amount of flotation material, and the related distribution of flotation material according to this prescription will be well within the skills of those practicing in the flotation products art.

Effecting the mating of fabric 12 to the contours of flotation panel 14 may occur in several ways. The preferred method at present is to adhesively bond a jersey-type, stretchable fabric to underlying flotation panel material to form a laminate. The laminate is then die-struck with a hot die which is configured as a negative image of the desired contouring for the laminate. This, of course, occurs for all contoured panel/fabric portions of garment 10.

Alternative methods may involve pressing fabric into place onto an adhesive covered, already contoured flotation panel, using a die which is appropriately contoured as a negative of the flotation panel. Also, fabric may be drawn onto the panel in a vacuum-based process, whereby a vacuum is drawn through a flotation panel to draw overlying fabric into conformity with the flotation panel. Still further, a positive airflow deposition process may involve use of a strong air flow from an outer surface of the garment fabric to drive the inner surface into conformity with the contours of the underlying flotation panel. Further, alternative manufacturing methods will be apparent to those skilled in the arts in which fabric is adhered to underlying, highly contoured objects, including foam-based objects, and need not be further elaborated in this context.

Although the invention has been described with reference to specific embodiments, this description is not meant to be construed in a limited sense. Various modifications of the disclosed embodiments, as well as alternative embodiments of the inventions will become apparent to persons skilled in the art upon the reference to the description of the invention. It is, therefore, contemplated that the appended claims will cover such modifications that fall within the scope of the invention.

We claim:

1. An improved flotation swim garment for children comprising:

a fabric assembly configured as a swim garment;

one or more flotation panels secured to said fabric assembly, said one or more flotation panels being contoured to include one or more elongate channels which are positioned and oriented, relative to said fabric assembly to which said one or more flotation panels are adhered, for accommodating bodily movement of a wearer of said swim garment;

respective, exteriorly visible portions of said fabric assembly which overlie said one or more flotation panels being adhered to said underlying one or more flotation panels whereby said portions substantially conform to the contours of said flotation panels.

2. The garment of claim 1 wherein one or more flotation panels are adhered to a front side of said fabric assembly, and one or more flotation panels are adhered to a rear side of said fabric assembly, and said flotation panels secured to said front side of said fabric assembly are configured to effect not less than 50% of the cumulative buoyancy of the combination of said flotation panels secured to said front and to said back sides of said fabric assembly.

* * * * *

US006871357C1

(12) EX PARTE REEXAMINATION CERTIFICATE (6320th)

United States Patent
Herman et al.

(10) Number: US 6,871,357 C1
(45) Certificate Issued: Jul. 22, 2008

(54) FLOTATION SWIM GARMENT FOR CHILDREN

(76) Inventors: Talia Herman, Box 2501, Waco, TX (US) 76702; Linda Karafortias, 10745 SW. Wedgewood St., Portland, OR (US) 97225

Reexamination Request:
No. 90/008,128, Jul. 18, 2006

Reexamination Certificate for:

| | |
|---|---|
| Patent No.: | **6,871,357** |
| Issued: | **Mar. 29, 2005** |
| Appl. No.: | **10/445,702** |
| Filed: | **May 23, 2003** |

(51) Int. Cl.
*A41D 7/00* (2006.01)
*A41D 5/00* (2006.01)

(52) U.S. Cl. ..... 2/67; 441/114

(58) Field of Classification Search ..... None
See application file for complete search history.

(56) References Cited

U.S. PATENT DOCUMENTS

| | | | |
|---|---|---|---|
| 2,629,118 | A | 2/1953 | Frieder |
| 5,823,838 | A | 10/1998 | Darcy |
| 6,235,661 | B1 | 5/2001 | Khanamirian |

FOREIGN PATENT DOCUMENTS

| | | |
|---|---|---|
| WO | WO 01/42081 | 7/2001 |

*Primary Examiner*—Beverly M. Flanagan

(57) ABSTRACT

A child's flotation swim garment which includes integral flotation panels. The panels include elongate indentations for facilitating movement and comfort for wearers, and overlying garment fabric is made to conform to the indentations of the flotation panels and present an outwardly visible indication of the contours of the underlying flotation panels.

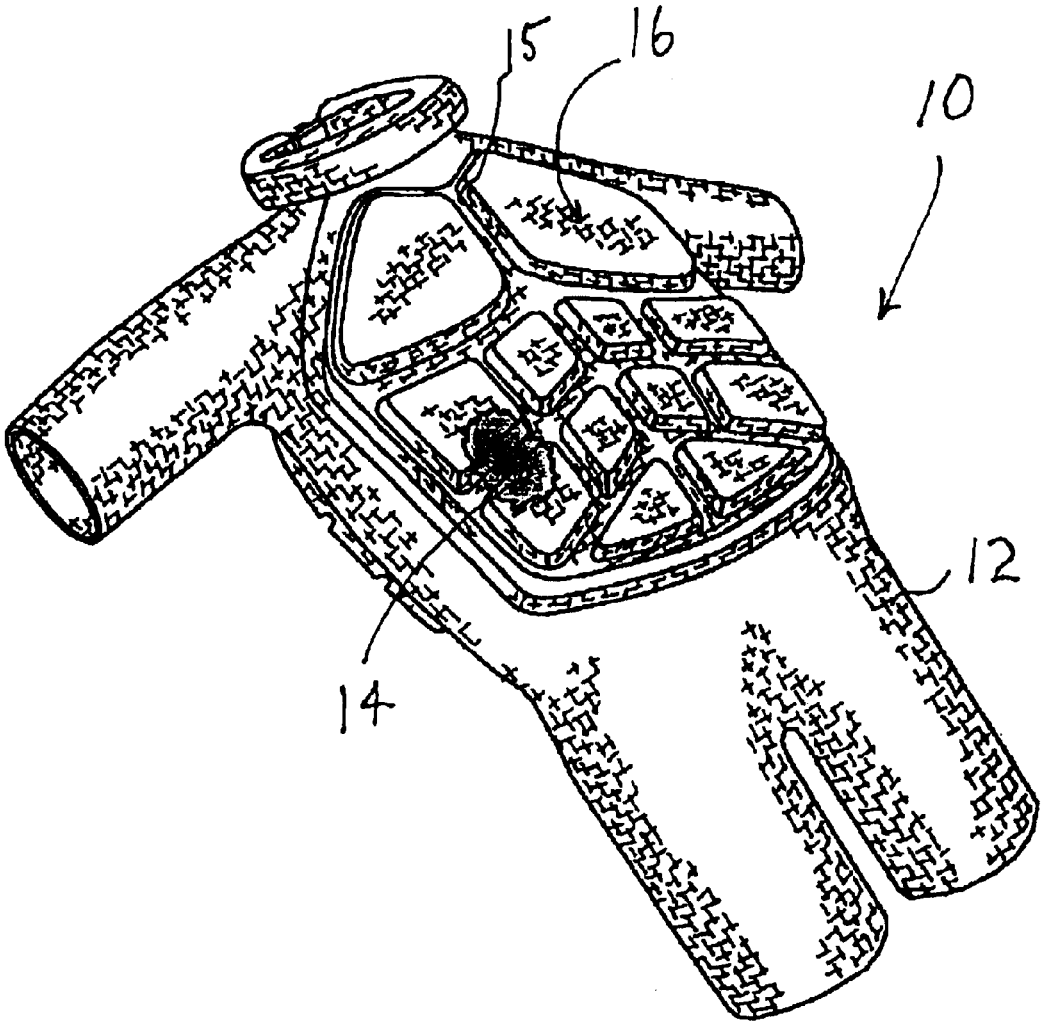

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1 and 2 are cancelled.

* * * * *